US005771302A

United States Patent [19]

Schindler

[11] Patent Number: 5,771,302

[45] Date of Patent: Jun. 23, 1998

[54] SUBWOOFER—LOUDSPEAKER BOX

[75] Inventor: Peter Schindler, Straubing, Germany

[73] Assignee: Nokai Technology GmbH, Pforzheim, Germany

[21] Appl. No.: 852,261

[22] Filed: May 6, 1997

[30] Foreign Application Priority Data

May 9, 1996 [DE] Germany ..... 296 08 421 U

[51] Int. Cl.[6] ..... H04R 25/00

[52] U.S. Cl. ..... 381/159; 381/188; 181/199

[58] Field of Search ..... 381/86, 87, 88, 381/89, 90, 158, 159, 188, 205; 181/145, 198, 199, 156

[56] References Cited

U.S. PATENT DOCUMENTS

| | | | |
|---|---|---|---|
| 2,689,016 | 9/1954 | Lang | 181/145 |
| 4,016,953 | 4/1977 | Butler | 181/199 |
| 4,549,631 | 10/1985 | Bose | 181/199 |
| 5,523,524 | 6/1996 | Prokisch et al. | 181/199 |

FOREIGN PATENT DOCUMENTS

| | | |
|---|---|---|
| 0379988 | of 0000 | European Pat. Off. . |
| 3410134 | of 0000 | Germany . |
| 3317518 | 11/1984 | Germany . |

*Primary Examiner*—Hyun Le

*Attorney, Agent, or Firm*—Ware, Fressola, Van Der Sluys & Adolphson LLP

[57] ABSTRACT

The invention presents a subwoofer-loudspeaker box which is essentially built in one piece. This one-piece housing is completed with a separation wall (20) which can be inserted through an installation opening (12). An insertion frame (16) is installed on the inside wall (15) of the box housing (10) to establish the necessary seal between the volumes (28.1, 28.2) which are divided by the separation wall (20). A seal (29) is also provided for the peripheral edge (27) of the separation wall (20). The separation wall (20) is furthermore equipped with a cover plate (21) which closes the installation opening (12) as soon as the separation wall (20) reaches its final position in the box housing (10).

8 Claims, 3 Drawing Sheets

SUBWOOFER— LOUDSPEAKER BOX

TECHNICAL FIELD

The invention concerns the construction of subwoofer-loudspeaker boxes, particularly the simplification of the capacity to manufacture such boxes.

BACKGROUND OF THE INVENTION

In the state of the art it is known to divide a box housing into two volumes by means of a separation wall, and to insert the loudspeaker into the separation wall. Such an arrangement is known for example from EP 0523410. This publication also states that one of the volumes formed by the separation wall inside the box is provided with a so-called port, which is located in the box housing and permits an exchange of air to take place between the inside of the box housing and the outside air surrounding the box. A two-port arrangement is shown for example in DE 34101134. Although the publications described so far indicate the use of only one loudspeaker in the separation wall, a push-pull loudspeaker arrangement is known from U.S. Pat. No. 4,016,953, and a push-pull arrangement in conjunction with a dual chamber box is known from EP 0379988.

The publications explained so far are mainly concerned with the effect of such boxes and therefore contain only little or no information about their construction. Taking the circumstance into account that the separation wall contains at least one loudspeaker, it can be stated that such boxes must have a box housing formed of at least two half shells. With reference to the arrangement shown in EP 0523410, this means that the sealed volume is a closed case except for the opening to install the loudspeaker, and that after the loudspeaker etc. has been installed, the separation wall is covered with a tube-shaped hood which forms the open volume, and the edges of the hood are screwed or cemented to the box. Another two-volume box housing is shown in DE 4344618.

Although this arrangement contains three chambers or volumes, the manufacture of such loudspeaker boxes with a loudspeaker arrangement in the separation wall can easily be derived from this publication. It can also be seen from this publication that boxed half shells with complicated shapes must be provided to build such a box housing.

In this connection it is considered a disadvantage that the respective half shells of the box, which ensure the eventual installation of loudspeakers, must be manufactured with separate tools, which adds to the production costs.

It is therefore the task of the invention to present a subwoofer-loudspeaker box that avoids the technical problems which exist during the manufacture.

PRESENTATION OF THE INVENTION

This task is fulfilled by a subwoofer-loudspeaker box with an outer box housing, with a separation wall which divides the volume surrounded by the box housing into two volumes, and where at least one of the formed volumes exchanges air with the outside air surrounding the box housing through a port, and with at least one loudspeaker which is connected to the separation wall, wherein the outer box housing is made in one piece, wherein the box housing has an insertion frame on its inside wall, wherein the box housing has an installation opening which lies crosswise to the plane of the insertion frame, and wherein the separation wall is equipped with a cover plate which closes the installation opening at least partially when the separation wall has been inserted through the installation opening into the insertion frame and has assumed its final position.

The box housing is produced in one piece and its inside wall is equipped with a molded insertion frame. The loudspeaker box can be built by inserting the separation wall equipped with the loudspeaker etc. into the insertion frame through an installation opening which is also provided in the box housing. Since the separation wall is equipped with a cover plate, and if said cover plate is larger than the installation opening, the latter is closed after the separation wall reaches its final position in the insertion frame.

If the cover plate seals the installation opening only partially; i.e. not completely, the remaining opening can be used as a port. This makes separate ports in the box housing superfluous.

If at least the cover wall is made of metal, this cover wall can be used to dissipate heat. The latter is particularly advantageous if the separation wall is equipped with an additional amplifier unit.

If the cover plate is provided with a contact strip for making contact with the loudspeaker(s) or the amplifier unit, no further installation openings are required in the box housing, which reduces the sealing effort.

BEST MODE FOR CARRYING OUT THE INVENTION

Figure 1:
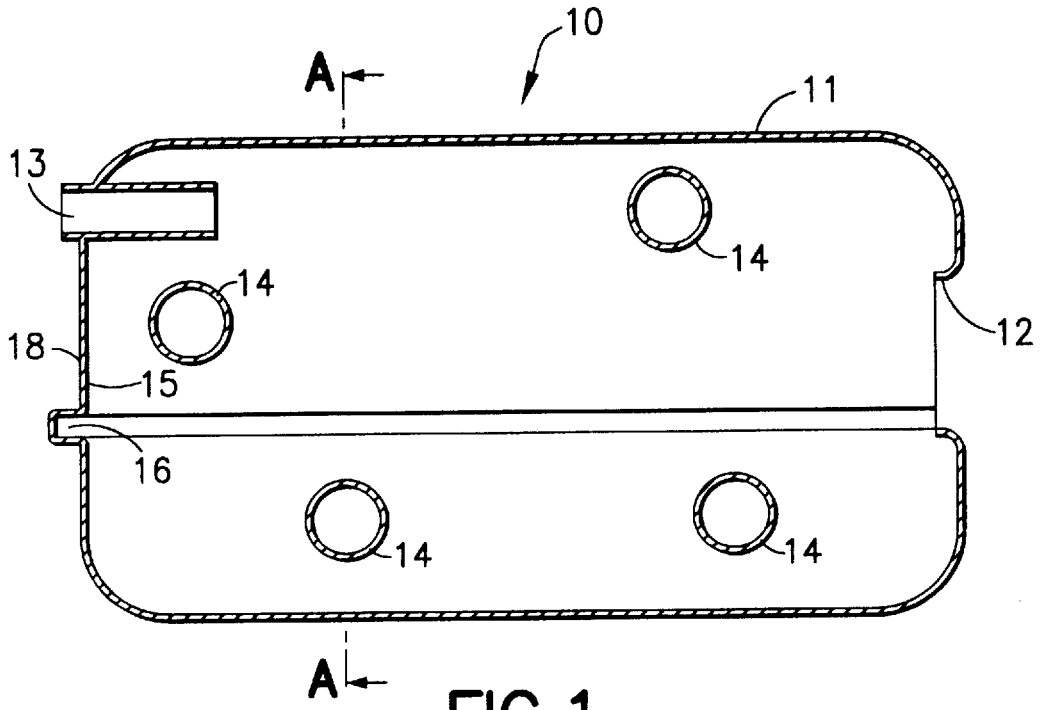
FIG. 1 is a cross section of a box housing.

FIG. 1 illustrates an essentially closed, somewhat cube-shaped box housing (10), where the outer skin (11) of this housing (10) is only broken by an installation opening (12) and a channel-shaped port (13). In addition four tube-shaped pull-throughs (14) pass through the inside of the box housing (10), which contributes to the mechanical stability of the box housing (10).

In addition, an insertion frame (16) is located on the inside wall (15) of the box housing (10) in FIG. 1, which has an approximately U-shaped profile as illustrated on the left side of FIG. 1. It can be seen on the right side of FIG. 1 that the insertion frame (16) ends where the installation opening (12) is placed in the outer skin (11) of the housing (10). The latter is essential to complete the loudspeaker box, as will be described later.

Figure 2:
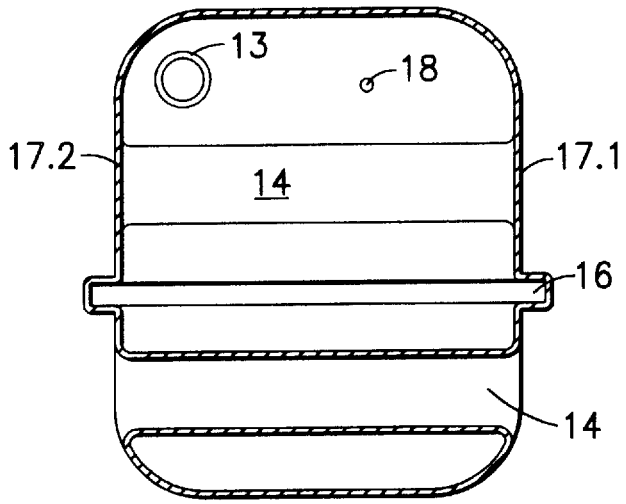
FIG. 2 is a cut along A—A in FIG. 1.

The conditions depicted until now in connection with FIG. 1 are illustrated further in FIG. 2. FIG. 2 is a cut along A—A in FIG. 1 which indicates that the insertion frame (16) runs along both lateral surfaces 17.1 and 17.2 as well as on the front surface (18) of the inside wall (15).

It should be pointed out for reasons of completeness alone that the box housing (10) in FIGS. 1 and 2 can be very simply made of plastic by using the rotational sintering process or the blasting technique.

Figure 3:
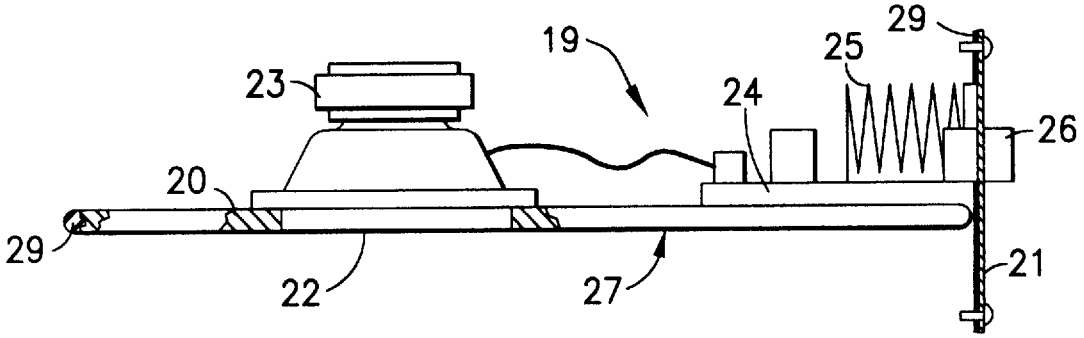
FIG. 3 is a side view of an acoustic module.

FIG. 3 illustrates an acoustic module (19). This acoustic module (19) essentially comprises a separation wall (20), a cover plate (21) which is connected to the separation wall (20), a loudspeaker (23) and an amplifier unit (24). The cover plate (21) can be provided with a contact strip (26) to establish a connection from the loudspeaker(s) (23) or the amplifier unit (24) to an external signal source (not shown).

The separation wall (20) has an opening (22) over which the loudspeaker (23) is mounted. The heat sink (25) of the amplifier unit (24) is connected to the cover plate (21) and to the separation wall (20). In the present configuration example the heat sink is made of metal for better heat dissipation. Insofar as the heat dissipation only plays a subordinate role, or where in another not illustrated configuration example the use of an amplifier unit (24) can be omitted, the cover plate (21) can also be made of plastic and possibly form a one-piece unit with the separation wall (20).

The cover plate (21) is furthermore equipped with a contact strip to make contact with the amplifier unit (24).

Figure 4:
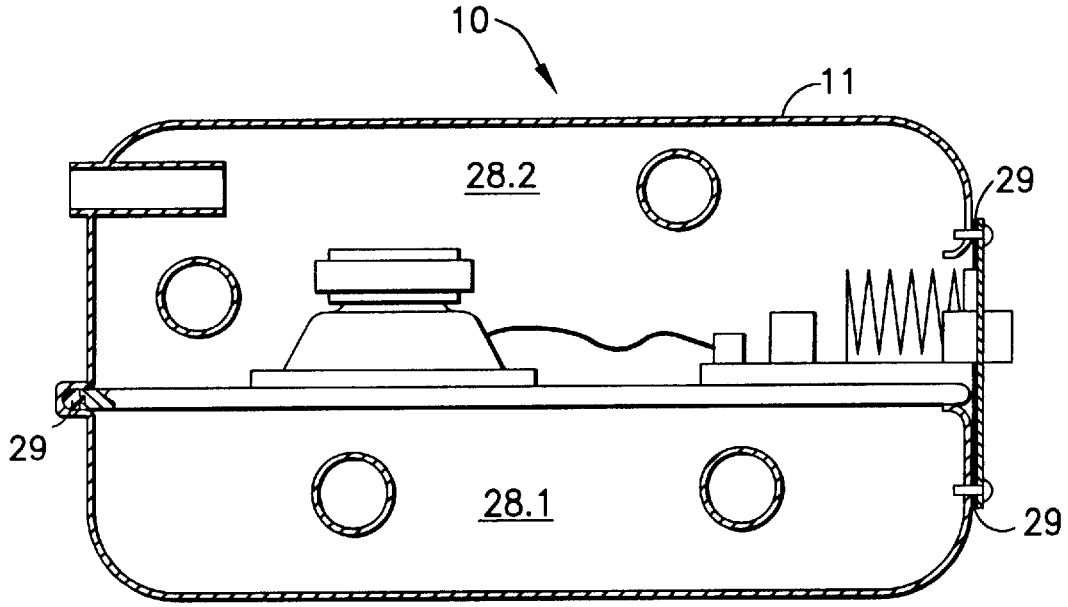
FIG. 4 is a combination of FIG. 1 and FIG. 3.

If the peripheral edge (27) of the separation wall (20) of an acoustic module (19) fully equipped in accordance with FIG. 3 is now inserted into the insertion frame (16) through the installation opening (12) of FIG. 1, an installed situation which is illustrated in FIG. 4 is achieved. Once the acoustic module (19) has reached its final position in the box housing (10), the installation opening (12) is closed by the cover plate (21). In this final position, the inside of the box housing (10) is additionally divided into a closed volume (28.1) and an open volume (28.2) because the peripheral edge (27) of the separation wall (20) is positioned in the insertion frame (16). It should be pointed out for reasons of completeness that the peripheral edge (27) of the separation wall (20) is equipped with a seal to ensure the reciprocal sealing of the two volumes (28.1) and (28.2). A seal (29) is also provided between the cover plate (21) and the outer skin (11) of the box housing (10).

Figure 5:
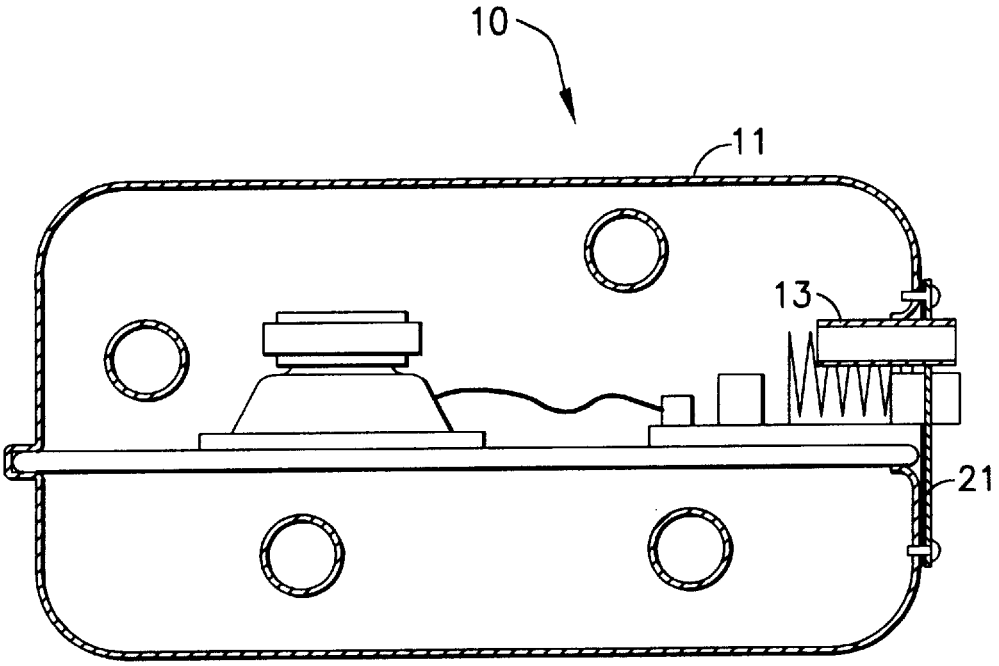
FIG. 5 is another combination of FIG. 4.

FIG. 5 illustrates a configuration which is slightly modified with respect to FIG. 4. In accordance with FIG. 5 the port (13) does not pass through the outer skin (11) of the box housing (10) proper, but is formed in the cover plate (21). The port (13) is tube-shaped in this case as well.

Insofar as no tube-shaped port (13) is required, the port opening needed in each instance can also be provided by a hole in the cover plate (21), or by not allowing the cover plate (21) to completely close the installation opening (12) in the box housing (10).

What is claimed is:

1. A subwoofer-loudspeaker box with an outer box housing (10), with a separation wall (20) which divides the volume surrounded by the box housing (10) into two volumes (28.1, 28.2), and where at least one of the two volumes exchanges air with the outside air surrounding the box housing (10) through a port (13), and with at least one loudspeaker (23) which is connected to the separation wall (20), characterized in that the outer box housing (10) is made in one piece, that the box housing (10) has an insertion frame (16) on its inside wall (15), that the box housing (10) has an installation opening (12) which lies crosswise to the plane of the insertion frame (16), and that the separation wall (20) is equipped with a cover plate (21) which closes the installation opening (12) at least partially when the separation wall (20) has been inserted through the installation opening (12) into the insertion frame (16).

2. A subwoofer-loudspeaker box as claimed in claim 1, characterized in that sealing means (29) are provided which prevent an exchange of air between the insertion frame (16) and a peripheral edge (27) of the separation wall (20), and between the installation opening (12) and the cover plate (21).

3. A subwoofer-loudspeaker box as claimed in claim 2, characterized in that the cover plate (21) only partially closes the installation opening (12) and that the area of the cover plate (21) which does not completely close the installation opening (12) forms the port (13).

4. A subwoofer-loudspeaker box as claimed in claim 3, characterized in that the separation wall (20) also supports an amplifier unit (24).

5. A subwoofer-loudspeaker box as claimed in claim 4, characterized in that the cover plate (21) is provided with a contact strip (26) to establish a connection from the loudspeaker (23) or the amplifier unit (24) to a signal source.

6. A subwoofer-loudspeaker box as claimed in claim 1 characterized in that the cover plate (21) only partially closes the installation opening (12) and that the area of the cover plate (21) which does not completely close the installation opening (12) forms the port (13).

7. A subwoofer-loudspeaker box as claimed in claim 1, characterized in that the separation wall (20) also supports an amplifier unit (24).

8. A subwoofer-loudspeaker box as claimed in claim 1, characterized in that the cover plate (21) is provided with a contact strip (26) to establish a connection from the loudspeaker(s) (23) or the amplifier unit (24) to a signal source.

* * * * *

UNITED STATES PATENT AND TRADEMARK OFFICE

CERTIFICATE OF CORRECTION

PATENT NO. : 5,771,302

DATED : June 23, 1998

INVENTOR(S) : Peter Schindler

It is certified that error appears in the above-identified patent and that said Letters Patent is hereby corrected as shown below:

On Title Page under [73] Assignee, "Nokai" should be --Nokia--.

Signed and Sealed this

Fifteenth Day of December, 1998

Bruce Lehman

*Attest:*

BRUCE LEHMAN

*Attesting Officer*

*Commissioner of Patents and Trademarks*